US008261503B2

(12) United States Patent
Meyer

(10) Patent No.: US 8,261,503 B2
(45) Date of Patent: Sep. 11, 2012

(54) FASTENER ELEMENT AND SYSTEM FOR CURING CONCRETE

(76) Inventor: Donald L. Meyer, East Peoria, IL (US)

( * ) Notice: Subject to any disclaimer, the term of this patent is extended or adjusted under 35 U.S.C. 154(b) by 531 days.

(21) Appl. No.: 12/079,695

(22) Filed: Mar. 28, 2008

(65) Prior Publication Data

US 2009/0241463 A1 Oct. 1, 2009

(51) Int. Cl.
*E04B 9/00* (2006.01)

(52) U.S. Cl. ..... 52/358; 52/426; 52/419; 52/357; 52/570; 52/712

(58) Field of Classification Search ..... 52/426, 52/418, 415, 419, 358, 357, 570, 712
See application file for complete search history.

(56) References Cited

U.S. PATENT DOCUMENTS

| | | | | |
|---|---|---|---|---|
| 1,739,254 | A * | 12/1929 | Mosel | 249/2 |
| 1,873,731 | A * | 8/1932 | Zingali | 24/268 |
| 2,477,381 | A | 7/1949 | Lewis | |
| 2,614,311 | A * | 10/1952 | Shook | 249/34 |
| 2,893,068 | A | 7/1959 | Johnson et al. | |
| 2,927,626 | A | 3/1960 | Corwin et al. | |
| 3,234,616 | A * | 2/1966 | Wantland | 24/543 |
| 3,277,626 | A * | 10/1966 | Brynjolfsson et al. | 52/713 |
| 3,377,764 | A * | 4/1968 | Storch | 52/713 |
| 3,659,077 | A * | 4/1972 | Olson | 219/213 |
| 3,722,849 | A * | 3/1973 | Luyben | 249/219.1 |
| 3,827,205 | A * | 8/1974 | Barbera | 52/426 |
| 3,862,876 | A | 1/1975 | Graves | |
| 4,257,571 | A * | 3/1981 | Franks | 249/207 |
| 4,485,137 | A * | 11/1984 | White | 428/57 |
| 4,708,558 | A | 11/1987 | Musil | |
| 5,707,179 | A | 1/1998 | Bruckelmyer | |
| 5,707,710 | A * | 1/1998 | Zafiroglu | 428/151 |
| 5,780,367 | A * | 7/1998 | Handwerker | 442/235 |
| 5,874,150 | A | 2/1999 | Handwerker | |
| 5,913,341 | A * | 6/1999 | Jones | 140/119 |
| 5,930,958 | A | 8/1999 | Stanley | |
| 6,128,882 | A * | 10/2000 | Jones | 52/665 |
| 6,173,937 | B1 * | 1/2001 | Cottongim | 249/40 |
| 6,178,711 | B1 * | 1/2001 | Laird et al. | 52/427 |
| 6,412,247 | B1 * | 7/2002 | Menchetti et al. | 52/847 |
| 6,990,774 | B2 * | 1/2006 | Clapp | 52/294 |
| 7,998,564 | B2 * | 8/2011 | Bliton et al. | 428/219 |

* cited by examiner

*Primary Examiner* — William Gilbert
*Assistant Examiner* — Chi Q Nguyen
(74) *Attorney, Agent, or Firm* — Amster, Rothstein & Ebenstein, LLP

(57) ABSTRACT

Provided is a fastener element for securing a curing blanket over the open upper end of a concrete form. The fastener element comprises a wire body including a central portion extending laterally for at least the distance of the width of the concrete form and a pair of attachment portions at opposite ends of the central portion. The attachment portions secure the fastener element to the outer walls of the concrete form.

8 Claims, 5 Drawing Sheets

FASTENER ELEMENT AND SYSTEM FOR CURING CONCRETE

FIELD OF THE INVENTION

The present invention relates to curing concrete, and more particularly, to a means for securing a curing blanket over a concrete form.

BACKGROUND OF THE INVENTION

Concrete forms are molds that are used for building concrete walls, and are often employed in conjunction with building the foundations of residential and commercial structures. The concrete form defines a cavity that delineates the desired shape of the wall. Concrete is poured into the cavity and allowed to cure to construct the wall.

Concrete forms can be of the removable or permanent type. Removable concrete forms are built on site out of lumber and plywood or constructed from a modular steel frame. Once the concrete is poured and cured, the temporary forms are removed. Permanent forms are left in place after the concrete has cured. Permanent forms, such as insulated concrete forms (ICF's) made of rigid plastic foam, remain in place after curing to serve as thermal insulation for the concrete walls.

During the concrete curing process, chemical changes occur in the presence of water which ensures that the hardened concrete will be water-tight and durable. These chemical changes occur over a considerable period of time requiring that the concrete be kept wet during the curing period. The heat radiating from the concrete during the curing process evaporates the moisture in the concrete, inhibiting the chemical hardening process and compromising the strength and durability of the cured concrete. It is therefore necessary to contain the heat and moisture in the concrete long enough to permit the curing process to be sufficiently completed.

The need for heat and moisture retention increases during cold weather applications. ICF's are often used during cold weather curing processes to insulate the concrete, allowing the concrete to cure while isolated from outside temperature and moisture. Additionally, curing blankets or other insulating materials such as straw, sawdust, and the like are placed over the exposed surface of the concrete along the upper end of the concrete form which further insulates the concrete and protects it from moisture.

However, it is difficult to maintain the insulating materials in place during the entire curing process when there is strong wind, rain, or snow, as often is the case during cold weather. Various approaches have been taken in attempts to secure the insulating materials. For example, attempts have been made to secure the curing blankets by string or tape, but these approaches have not been very successful or efficient.

Thus, there is a need for an effective, efficient, and low cost means for attaching and retaining curing blankets over the upper end of a concrete form.

SUMMARY OF THE INVENTION

According to one exemplary embodiment, a fastener element is provided for securing a curing blanket over the open upper end of a concrete form. The fastener element comprises a wire body including a central portion extending laterally for at least the distance of the width of the concrete form and a pair of attachment portions at opposite ends of the central portion. The attachment portions secure the fastener element to the outer walls of the concrete form.

In at least one embodiment, each of the attachment portions comprises a leg portion extending downward from one end of the central portion and an arm portion extending inwardly from the distal end of the leg portion toward the center of the fastener element.

In at least one embodiment, the leg portion is inclined inwardly.

In at least one embodiment, the leg portion includes two or more segments.

In at least one embodiment, the arm portion is inclined upwardly.

In at least one embodiment, the distal end of the arm portion is shaped to define a point for penetrating the outer wall of the concrete form.

In at least one embodiment, the central portion is configured to include a vertical component.

In at least one embodiment, the central portion includes two or more segments.

According to one exemplary embodiment, a system for curing concrete is provided. The system for curing concrete comprises a concrete form having an opening in the upper end for receiving concrete. A curing blanket is provided for covering the opening in the upper end of the concrete form. At least one fastener element is provided for securing the curing blanket over the upper end of the concrete form. The fastener element comprises a wire body including a central portion extending laterally for at least the distance of the width of the concrete form and a pair of attachment portions at opposite ends of the central portion. The attachment portions secure the fastener element to the outer walls of the concrete form.

In at least one embodiment, each of the attachment portions comprises a leg portion extending downward from one end of the central portion and an arm portion extending inwardly from the distal end of the leg portion toward the center of the fastener element.

In at least one embodiment, the leg portion is inclined inwardly.

In at least one embodiment, the leg portion includes two or more segments.

In at least one embodiment, the arm portion is inclined upwardly.

In at least one embodiment, the distal end of the arm portion is shaped to define a point for penetrating the outer wall of the concrete form.

In at least one embodiment, the central portion is configured to include a vertical component.

In at least one embodiment, the central portion includes two or more segments.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures.

DETAILED DESCRIPTION OF THE EXEMPLARY EMBODIMENTS

Figure 1:
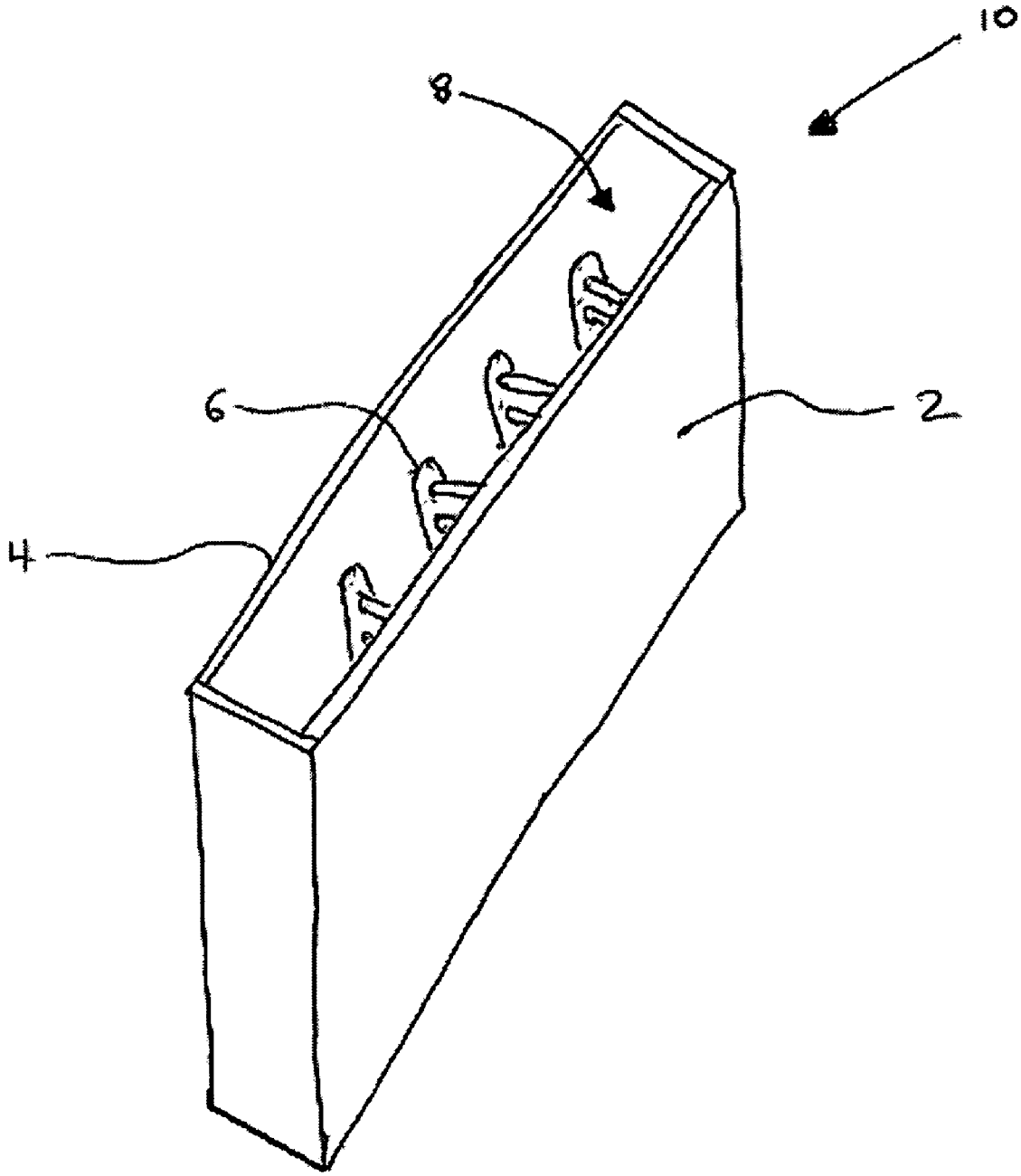
FIG. 1 is a perspective view of a conventional concrete form.

FIG. 1 is a perspective view of a conventional concrete form 10. The concrete form illustrated in FIG. 1 is an insulated concrete form (ICF). However, the concrete form 10 may be an ICF comprised of a foam block defining a cavity or opening. The concrete form 10 may also be other types of concrete forms, such as a modular steel form or a form built from lumber and plywood.

As shown in FIG. 1, the concrete form 10 is constructed from foam panels 2 and 4 that are held together with plastic, metal, or integral foam ties 6. The foam panels 2 and 4 are comprised of expanded or extruded polystyrene and typically have a width of at least 2 inches. The foam panels 2 and 4 are spaced apart to define a cavity or opening 8 in the upper end of the concrete form 10 into which the concrete is poured. The cavity 8 is sized to the width of the desired concrete wall, which typically ranges from between 4 to 12 inches.

Concrete is poured into the opening 8 to the appropriate wall height. Finishing operations, such as leveling and smoothing, are then performed on the concrete.

Figure 2:
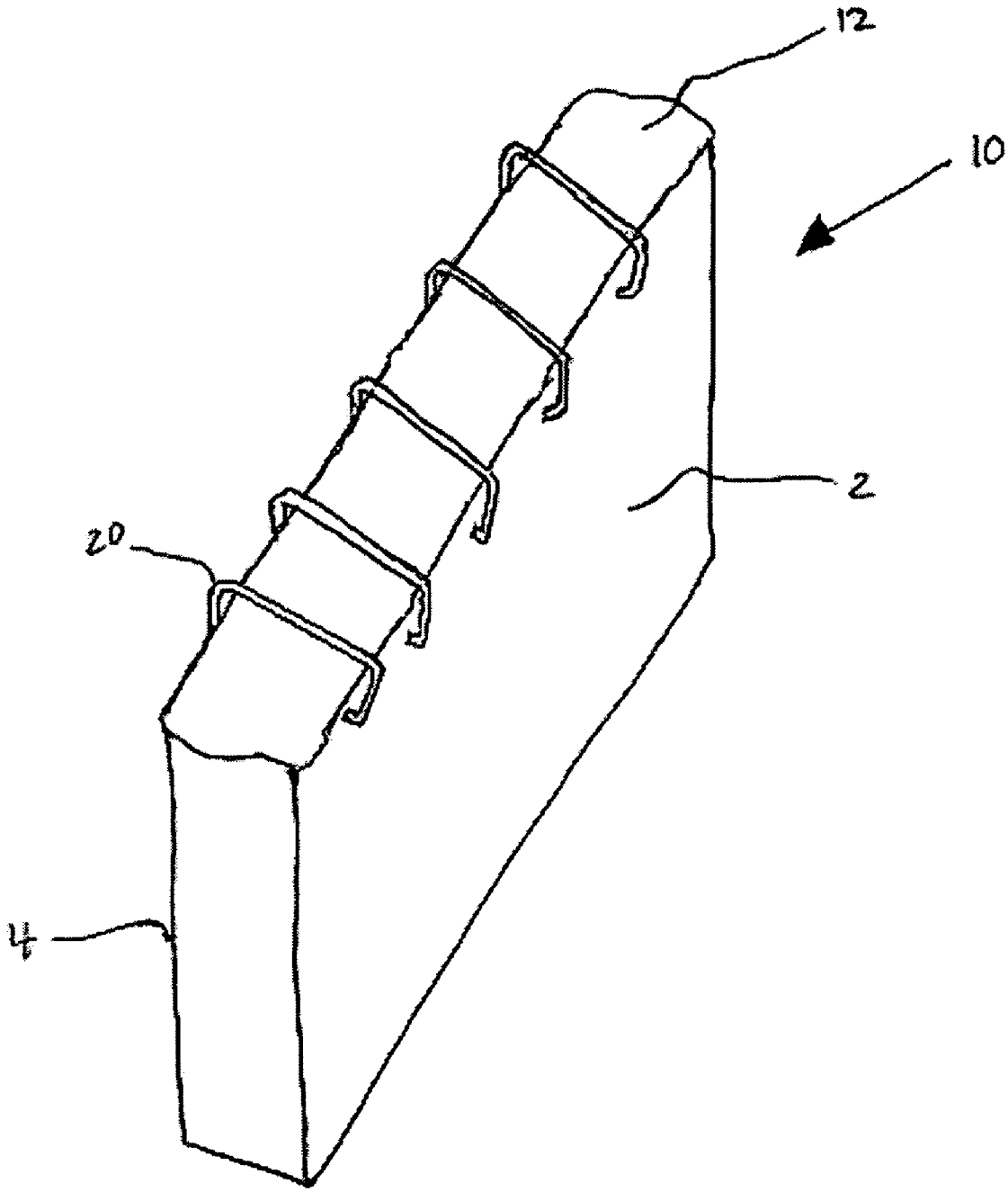
FIG. 2 is a perspective view of a concrete form covered by a curing blanket secured in place by fastener elements according to the present invention.

As shown in FIG. 2, a curing blanket 12 is placed over the opening 8 in the concrete form 10 during the curing process. Fastener elements 20, as described below, are attached over the curing blanket 12 at the upper end of the concrete form 10 to secure the curing blanket 12 in place. Multiple fastener elements 20 are spaced apart at intervals along the concrete form 10.

Figure 3:
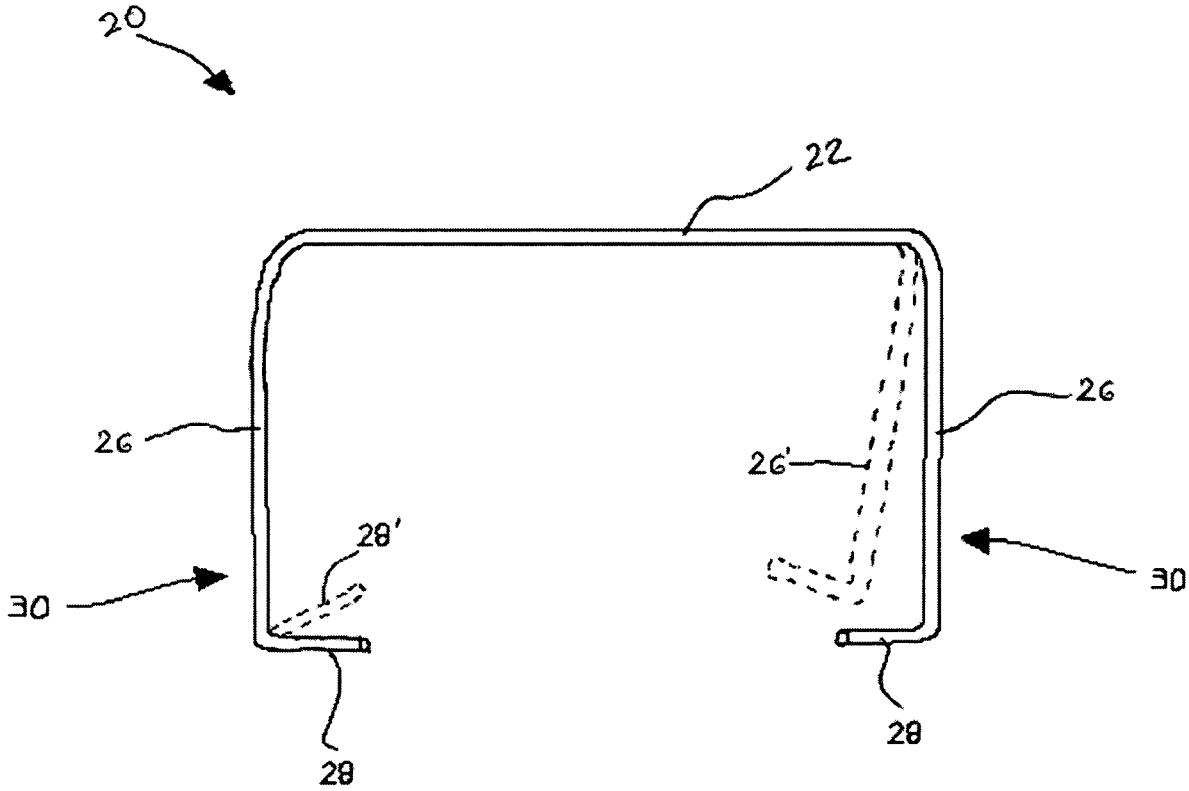
FIG. 3 is a side view of a fastener element according to an exemplary embodiment of the present invention.
Figure 4:
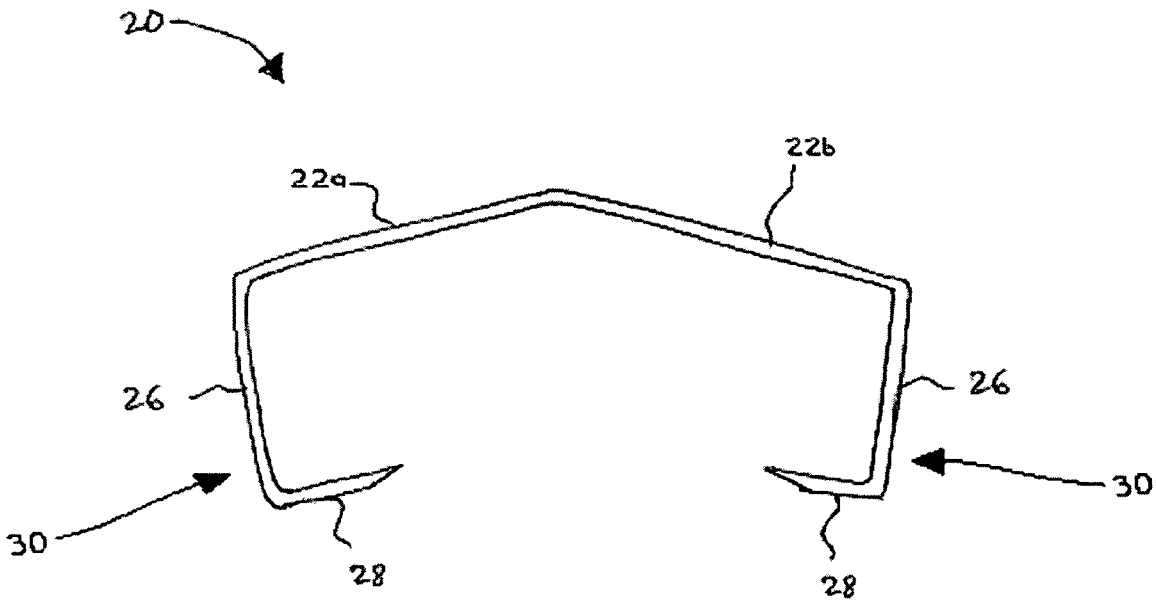
FIG. 4 is a side view of a fastener element according to an exemplary embodiment of the present invention.
Figure 5:
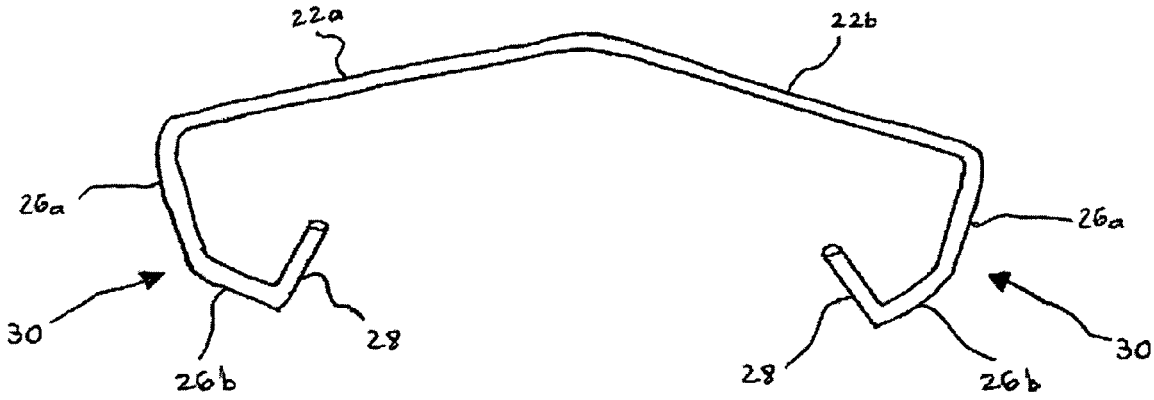
FIG. 5 is a side view of a fastener element according to an exemplary embodiment of the present invention.

FIGS. 3-5 illustrate a fastener element 20 according to exemplary embodiments of the present invention. The fastener element 20 embodies a single piece of bent metal wire including a central portion 22 and two attachment portions 30 that are used to secure the fastener element 20 over the upper end of the concrete form 10. However, it is not intended to limit the invention to a single piece of bent wire, as a plurality of pieces of wire may also be joined together to form the fastener element 20.

The central portion 22 extends a lateral distance that is equal to or greater than of the width of the concrete form 10. In other words, the central portion 22 spans the cavity 8 defined by the concrete form 10 and extends out to or beyond the outer surfaces of the foam panels 2 and 4.

The central portion 22 may be a straight lateral segment as shown in FIG. 3, but preferably the central portion 22 is configured to include a vertical component. The vertical component of the central portion 22 provides a means for increasing the downward force that can be applied to the fastener element 20, which assists in pushing the fastener element 20 down over the upper end of the concrete form 10.

For example, the central portion 22 may be configured to include a vertical component by bending the central portion 22 into a curved arch or by bending the central portion 22 into two or more segments. As shown in FIGS. 4 and 5, the central portion 22 may be a configured to form a triangular shape in which two segments 22*a* and 22*b* are inclined from the opposing ends of the central portion 22 toward the center of the central portion 22. The transition between the segments 22*a* and 22*b* may be curved or may form a sharper angle.

The two attachment portions 30 are disposed at opposite ends of the central portion 22. Each of the attachment portions 30 includes a leg portion 26 and an arm portion 28. The leg portion 26 extends downward from one end of the central portion 22. The arm portion 28 extends inward from the distal end of the leg portion 26 toward the center of the fastener element 20.

The leg portions 26 may be substantially transverse to the central portion 22 as shown in FIG. 3, but preferably the leg portions 26 are also inclined inwardly. The inward incline of the leg portions 26 provides a means for increasing the inward force applied by the leg portions 26 to push the arm portions 28 against the outer surfaces of panels 2 and 4 of the concrete form 10.

For example, the leg portions 26 may be inclined inwardly by configuring the leg portions 26', as shown by the dotted lines of FIG. 3, wherein the angle between the central portion 22 and the leg portion 26' is an acute angle instead of a right angle. The leg portions 26 may also be inclined inwardly as a result of configuring the central portion 22 as shown in FIG. 4.

The leg portions 26 may also be configured to include two or more segments. The two or more segments of the leg portions 26 provide a means for increasing the elasticity of attachment portions 30.

For example, as shown in FIG. 5, each of the leg portions 26 includes two segments 26*a* and 26*b*. The first segment 26*a* extends downward from one end of the central portion 22, and may also extend inwardly. The second segment 26*b* extends inwardly from the distal end of the first segment 26*a*, and may also extend downward.

The arm portions 28 may be substantially transverse to the leg portions 26 as shown in FIG. 3, but preferably the arm portions 28 are also inclined upwardly. The upward incline of the arm portions 28 increases the ability of the arm portions 28 to resist being pulled away from the panels 2 and 4 of the concrete form 10 when an upward force is exerted against the fastener element 20.

For example, the arm portions 28 may be inclined upwardly by configuring the arm portions 28' as shown by the dotted lines of FIG. 3, wherein the angle between the leg portions 26 and the arm portions 28' is an acute angle instead of a right angle. The arm portions 28 may also be inclined upwardly by configuring the leg portions 26', as shown by the dotted lines of FIG. 3, wherein the angle between the central portion 22 and the leg portions 26' is an acute angle instead of a right angle. Further, the arm portions 28 may be inclined upwardly as a result of configuring the central portion 22 and leg portions 26 as shown in FIGS. 4 and 5.

The distal ends of the arm portions 28 may rest against the outer surface of the concrete form 10, or, particularly when the concrete form 10 is an ICF or constructed from lumber and plywood, the distal ends of the arm portions 28 may be penetrated through the outer panels 2 and 4 of the concrete form 10. By penetrating the arm portions 28 through the outer panels 2 and 4, the fastener element 20 may be more securely attached to the concrete form 10.

The distal ends of the arm portions 28 may be flat or angularly shaped to define a point. The pointed distal ends of the arm portions 28 can be used to assist in penetrating the arms portions 28 through the outer panels 2 and 4 of the concrete form 10.

Now that exemplary embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A system for curing concrete comprising:

a concrete form having an opening in an upper end for receiving concrete;

a curing blanket for covering said opening in said upper end of said concrete form; and at least one fastener element for securing said curing blanket over said upper end of said concrete form, said fastener element comprising:

a wire body;

a central portion of said wire body extending laterally for at least a distance of the width of said concrete form;

a pair of attachment portions at opposite ends of said central portion securing said fastener element to the outer walls of said concrete form by engaging against an outer side surface of said outer walls of said concrete form; and wherein said fastener element secures said curing blanket over said open upper end of said concrete form by said pair of attachment portions engaging against said outer surface of said concrete form and said central portion of said wire body traversing the open upper end of said concrete form.

2. The system of claim 1, wherein each of said attachment portions comprises:

a leg portion extending downward from one end of said central portion; and an arm portion extending inwardly from the distal end of said leg portion toward the center of said fastener element.

3. The system of claim 2, wherein said leg portion is inclined inwardly.

4. The system of claim 3, wherein said leg portion includes two or more segments.

5. The system of claim 2, wherein said arm portion is inclined upwardly.

6. The system of claim 2, wherein the distal end of said arm portion is shaped to define a point for penetrating the outer wall of said concrete form.

7. The system of claim 2, wherein said central portion is configured to include a vertical component.

8. The system of claim 7, wherein said central portion includes two or more segments.

* * * * *